US005078540A

United States Patent [19]

Jakob et al.

[11] Patent Number: 5,078,540

[45] Date of Patent: Jan. 7, 1992

[54] ASPHALT PAVEMENT MILLING MACHINE AND CUTTER DRUM THEREFOR

[75] Inventors: Herbert E. Jakob, Taylors, S.C.; Thomas R. Campbell, Chattanooga, Tenn.

[73] Assignee: Astec Industries, Inc., Chattanooga, Tenn.

[21] Appl. No.: 573,337

[22] Filed: Aug. 24, 1990

[51] Int. Cl.[5] ..... E01C 23/08; E01C 47/00; E21B 10/00

[52] U.S. Cl. ..... 404/90; 299/39; 299/91

[58] Field of Search ..... 404/90, 91; 299/91, 299/93, 88, 39

[56] References Cited

U.S. PATENT DOCUMENTS

| | | | |
|---|---|---|---|
| 1,059,463 | 4/1913 | Hess . | |
| 1,084,871 | 1/1914 | Tuck . | |
| 1,586,151 | 5/1926 | Hess . | |
| 1,790,758 | 2/1931 | Montano et al. | 299/39 |
| 3,598,447 | 8/1971 | Bower | 299/91 |
| 3,827,755 | 8/1974 | Allen . | |
| 4,193,636 | 3/1980 | Jakob | 299/39 |
| 4,261,620 | 4/1981 | Troxler | 299/91 |
| 4,268,089 | 5/1981 | Spence et al. . | |
| 4,340,256 | 7/1982 | Hart . | |
| 4,480,873 | 11/1984 | Latham | 299/87 |
| 4,542,943 | 9/1985 | Montgomery | 299/91 X |
| 4,603,911 | 8/1986 | Hindmarsh | 299/91 |
| 4,621,871 | 11/1986 | Salani | 299/91 |
| 4,690,461 | 9/1987 | Rink | 299/87 X |
| 4,697,850 | 10/1987 | Tuneblom | 299/87 |
| 4,978,173 | 12/1990 | Rothkegal | 299/91 X |

*Primary Examiner*—Ramon S. Britts
*Assistant Examiner*—Nancy Connolly
*Attorney, Agent, or Firm*—Bell, Seltzer, Park & Gibson

[57] ABSTRACT

A cutter drum of the type adapted for use in milling a roadway surface is disclosed, and which comprises a plurality of flighting assemblies fixed to the surface of the drum in a helical configuration. Each flighting assembly comprises a base plate which is aligned with a plane which perpendicularly intersects the central axis of the drum, and rear and forward support blocks fixed to one side of the base plate to define a channel therebetween. A tooth holder is mounted in the channel, and the holder has an outer portion which extends radially above the outer edge of the base plate, and the tooth holder is releasably mounted in the channel by means of a bolt. The portion of the tooth holder in the channel is protectively covered by the side surface of the base plate of an adjacent assembly.

16 Claims, 2 Drawing Sheets

Fig. 1.
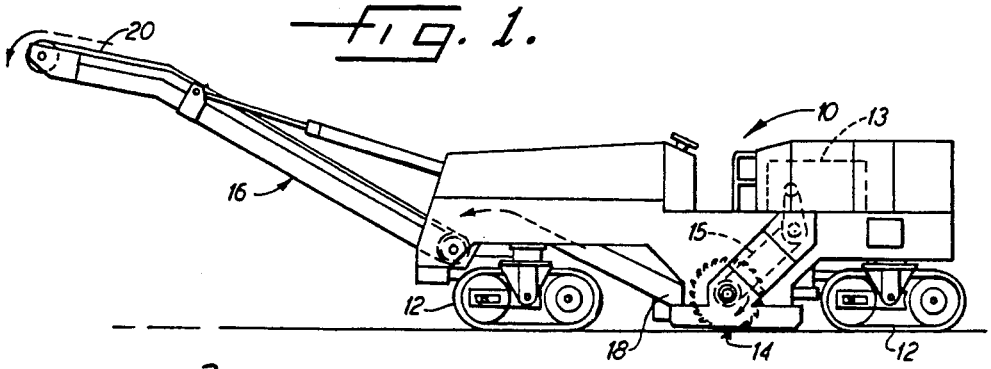
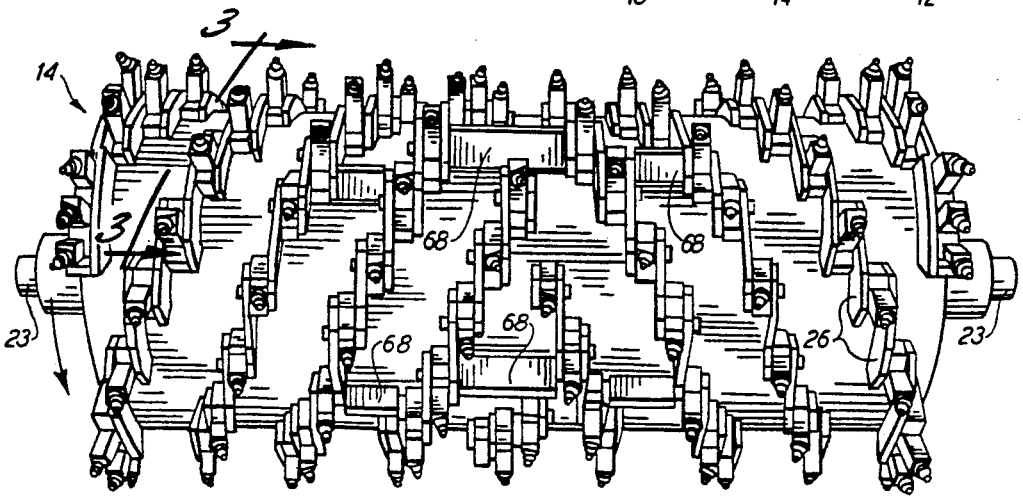
Fig. 2.
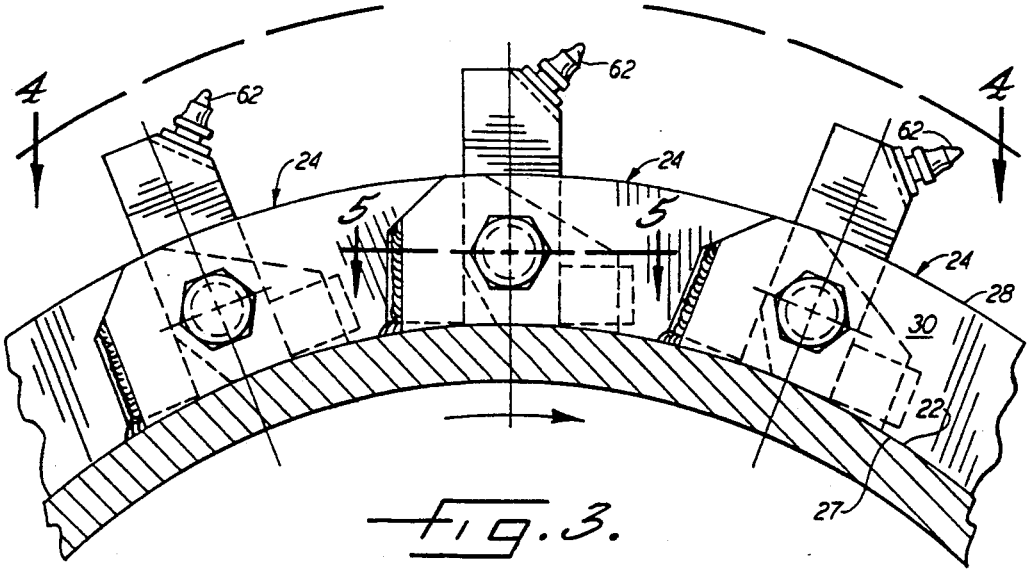
Fig. 3.

ASPHALT PAVEMENT MILLING MACHINE AND CUTTER DRUM THEREFOR

BACKGROUND OF THE INVENTION

The present invention relates to a self-propelled apparatus for removing a thickness of asphalt paving from an asphalt roadway, and more particularly to a novel cutting drum utilized in such apparatus.

Deteriorating asphalt roadways have in the past been rehabilitated by a process wherein the top layer of the asphalt roadway is removed by a drum type milling machine which is advanced along the roadway. The removed asphalt is then trucked to a reprocessing plant where it is usually blended with new aggregate and hot liquid asphalt in a rotary heater to form a new asphalt paving material. This new material is then trucked back to the roadway while hot and laid on the roadway by a conventional paver. Milling machines of the described type are disclosed for example, in U.S. Pat. No. 4,697,850 to Tuneblom, U.S. Pat. No. 4,480,873 to Latham, and U.S. Pat. No. 4,193,636 to Jakob.

As an alternative to the above process, U.S. Pat. No. 4,946,307 to Jakob discloses an apparatus for the cold, in-place recycling of asphalt, and which includes a cylindrical milling drum mounted at a medial location along its longitudinal length for removing a thickness of the asphalt paving.

The cutting teeth of the drums of the prior art milling machines commonly include a tooth holder which mounts a removable tooth. The teeth rapidly wear out during operation, and must be replaced on an almost daily basis, and in addition, the holders commonly break and must also be replaced. The replacement of the teeth and holders thus presents a significant maintenance problem, which is complicated by the fact that the teeth and holders often become coated with asphalt which tends to "weld" the components in place and renders them difficult to remove.

It is accordingly an object of the present invention to provide an apparatus for milling a roadway surface and which has a cutter drum with cutting assemblies which are constructed to avoid excessive wear and so as to reduce the likelihood of damage to the cutting teeth and holders.

It is a more particular object of the present invention to provide a cutter drum of the described type and which provides for the ready removal of both the cutting teeth and the tooth holders in the event they become damaged or worn.

SUMMARY OF THE INVENTION

The above and other objects of the present invention are achieved in the embodiment illustrated herein by the provision of a cutter drum which comprises a cylindrical drum surface defining a central axis, and a plurality of flighting assemblies fixed to the surface of the cutting drum in a helical configuration. Each flighting assembly comprises a base plate having an inner edge fixed to the surface of the drum, an outer edge generally concentric to the surface of the drum, and opposite side surfaces, and with the base plate being aligned with a plane which perpendicularly intersects the central axis. A rear support block is fixed to one of the side surfaces of the base plate, and a forward support block is fixed to the same side surface of the base plate and spaced from the rear support block so as to define a channel therebetween which is directed generally radially with respect to the central axis. A tooth holder is positioned in the channel and has an outer portion which extends radially above the outer edge of the base plate. The tooth holder is releasably mounted in the channel, and a cutting tooth is mounted to the outer portion of the tooth holder. Also, the flighting assemblies are arranged in a laterally side by side and circumferentially offset relationship so as to define the helical configuration.

In the preferred embodiment, the rear support block and the forward support block include coplanar outer surfaces on the side thereof opposite the base plate, and the flighting assemblies are arranged such that the coplanar outer side surfaces of the rear and forward support blocks of each assembly are covered and engaged by the inner side surface of the base plate of an adjacent assembly, and such that the inner side surface of the adjacent assembly overlies and covers the channel and the lower portion of the tooth holder of the first mentioned assembly.

The cutter drum as described above comprises a part of an apparatus for milling the roadway surface, and wherein the cutter drum is mounted for rotation about a generally horizontal central axis and so as to engage the roadway surface. The apparatus further comprises a prime mover for advancing the apparatus along the roadway, and for rotating the drum about the central axis. Further, the apparatus comprises a conveyor means having an inlet end positioned immediately forwardly of the drum, and such that rotation of the drum tends to lift the milled material into the inlet end of the conveyor means.

BRIEF DESCRIPTION OF THE DRAWINGS

Some of the objects and advantages of the present invention having been stated, others will appear as the description proceeds when taken in conjunction with the accompanying drawings, in which FIG. 1 is a side elevation view of an apparatus for milling a roadway surface which embodies the features of the present invention;

FIG. 2 is a rear perspective view of the cutter drum of the apparatus shown in FIG. 1;

FIG. 3 is a fragmentary sectional view taken substantially along the line 3—3 of FIG. 2;

DESCRIPTION OF THE PREFERRED EMBODIMENT

Figure 4:
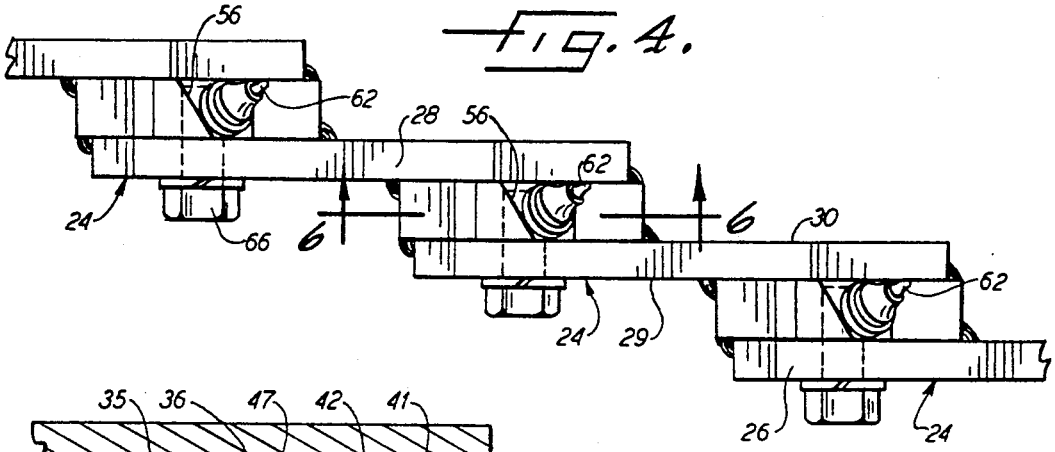
FIG. 4 is a top plan view of the structure shown in FIG. 3.

Referring more particularly to the drawings, an apparatus embodying the features of the present invention, is indicated generally at 10. The apparatus comprises a wheeled vehicle which is supported by three ground engaging tracks 12. As is conventional, the three tracks may all be steerable to provide precise directional control, and they are driven by hydraulic motors (not shown) which are in turn powered by a prime mover, such as an internal combustion engine 13.

The apparatus mounts a cylindrical milling drum 14, the structure of which is described in detail below, and with the drum being mounted to the frame of the vehicle at a medial location along its length, and for rotation about a horizontal transverse axis. The drum 14 is rotatably driven by the internal combustion engine 13 via a pulley drive system 15. As indicated by the directional arrow, the drum is rotated by the engine in a clockwise direction as seen in FIG. 1.

The apparatus 10 is designed to convey the milled roadway material in the forward direction for deposit into a truck (not shown). For this purpose, the apparatus includes a two-part conveyor system 16 which has an inlet end 18 positioned immediately forwardly of the drum 14, and an elevated outlet end 20 positioned forwardly of the apparatus. Thus rotation of the drum 14 in the indicated direction tends to lift the milled material into the inlet end 18 of the conveyor system, which in turn conveys the material to the outlet end 20, where it drops into the accompanying truck.

As best seen in FIGS. 2–4, the cutter drum 14 includes a cylindrical outer surface 22 which is concentric with the end mounting shafts 23 which in turn define the central or rotational axis of the drum. A plurality of flighting assemblies 24 are fixed to the surface of the cutting drum, as by welding, with the assemblies being arranged to define oppositely directed helices as further described below.

Each flighting assembly comprises a base plate 26 having a curved inner edge 27 fixed to the surface 22 of the drum, an outer edge 28 generally concentric to the surface of the drum, an inner side surface 29, an outer side surface 30, and a forward end portion (right end portion as seen in FIG. 4) and a rear (or left) end portion. Each base plate is mounted so as to be aligned with a plane which perpendicularly interests the central axis of the drum.

A rear support block 34 is fixed, as by welding, to the outer side surface 30 of the base plate at the rear end portion thereof, and the rear support block 34 has a planar outer surface 35 on the side thereof opposite the base plate, and a forwardly facing surface 36. A forward support block 38 is fixed, as by welding, to the outer surface of the base plate forwardly of the rear support block 34 so as to define a channel therebetween which is directed generally radially with respect to the central axis. The forward support block 38 has a radial height which is somewhat less than one half the radial height of the rear support block 34, and it has planar outer surface 41 on the side thereof opposite the base plate and which is coplanar with the outer surface 35 of the rear support block 34. The forward support block 38 also defines a rearwardly facing surface 42.

Figure 6:
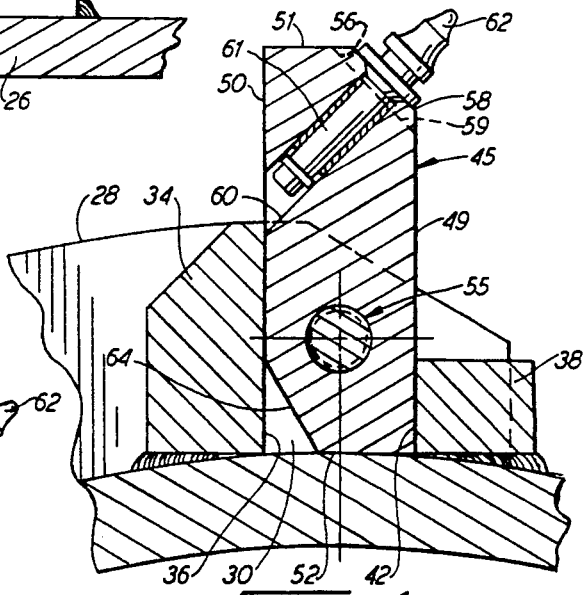
FIG. 6 is a sectional view taken substantially along the line 6—6 of FIG. 4.
Figure 7:
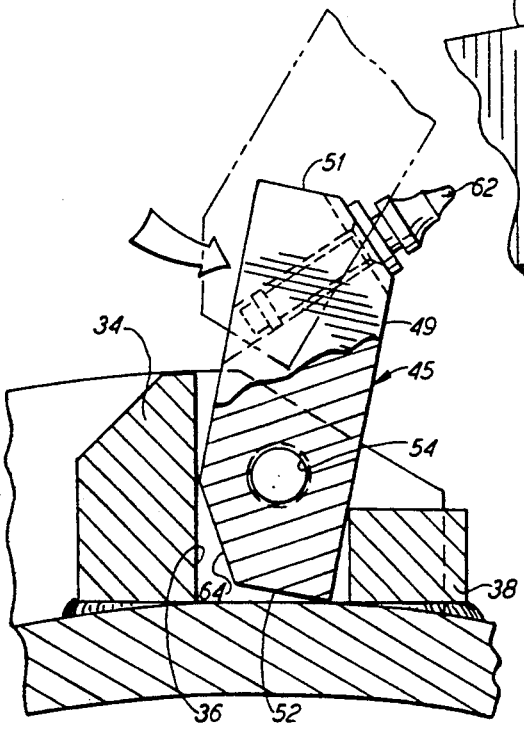
FIG. 7 is a view similar to FIG. 6 and illustrating the process for removing a tooth holder in accordance with the present invention.

As best seen in FIGS. 6 and 7, the channel of each assembly is more specifically defined by the forwardly facing surface 36 on the rear support block, the rearwardly facing surface 42 on the forward support block, and the portion of the outer side surface 30 of the base plate 26 which lies therebetween.

Each assembly 24 further comprises a tooth holder 45 positioned in the channel and which has an outer portion which extends radially above the outer edge 28 of the base plate 26. Each tooth holder 45 comprises a six sided solid metallic body member and which includes parallel opposite side faces 47, 48, parallel front and rear edges 49, 50 and parallel upper and lower end edges 51, 52. The separation between said upper and lower end edges 51, 52 is substantially greater than the separation between said opposite side faces 47, 48 or between said front and rear edges 49, 50, so as to provide the desired radial height as noted above.

A transverse threaded bore 54 extends laterally between said opposite side faces 47, 48 of the holder, and generally adjacent said lower end edge thereof for receiving a mounting bolt 55 therein. Also, a first beveled flat surface 56 is provided which extends between the upper end edge 51 and the front edge 49, and the surface 56 is inclined at an angle so as to intersect the side faces 47, 48 along respective parallel lines 58, 59 which are spaced unequal distances from the imaginary intersection of the upper end edge 51 and the front edge 49, note FIG. 6. A second bore 60 perpendicularly communicates with the first beveled surface 56, and it also communicates with the rear edge 50. The second bore 60 is adapted to releasably mount the shaft 61 and retaining sleeve of a cutting tooth 62 therein in the conventional manner, and the inclination of the surface 56 and the bore 60, results in each tooth 62 being forwardly inclined at an angle of about 40° from a radial line from the central axis of the drum, and as best seen in FIG. 4, each tooth is also laterally inclined at an angle of about 6° with respect to the plane of the plate 26.

Figure 5:
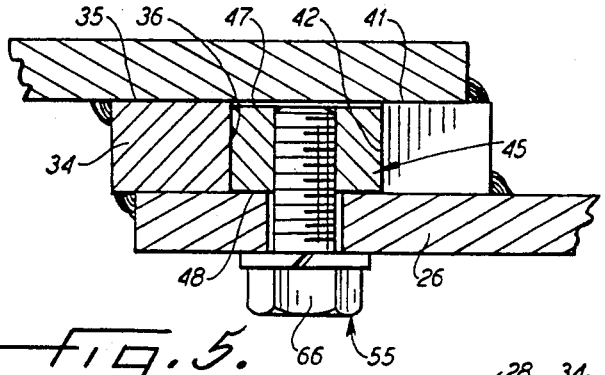
FIG. 5 is a sectional view taken substantially along the line 5—5 of FIG. 3.

A second beveled surface 64 extends between the rear edge 50 and the lower end edge 52 of the holder, for facilitating the removal of the tooth holder 45 from the mounting channel. As best seen in FIGS. 5 and 6, the tooth holder 45 is mounted in the channel by the bolt 55 which extends laterally through the base plate 26, and threadedly engages the bore 54 of the holder. The bolt 55 includes a head 66 which is positioned adjacent the inner side surface 29 of the base plate 26. Also, in the operative position, it is preferred that the lower end edge 52 of the tooth holder engage the surface 22 of the drum so as to provide support to the holder in the radial direction, and also to thereby provide close control of the radial height of the holder.

The flighting assemblies 24 are arranged on the surface of the drum such that the coplanar outer side surfaces 35 and 41 of the rear and forward support blocks of each assembly are covered and engaged by the inner side surface 29 of the base plate of an adjacent assembly at the forward end portion thereof. By this arrangement, the inner side surface 29 of the adjacent assembly overlies and protectively covers the channel and the lower portion of the tooth holder 45 of the first mentioned assembly. Also, the flighting assemblies 24 will be seen to be arranged in a laterally side-by-side and circumferentially offset relationship, so as to define the above described helical configuration.

The cutting drum 14 further mounts a plurality of laterally extending and radially directed lifting plates 68 (FIG. 2) which extend between selected laterally adjacent flighting assemblies 24 adjacent the longitudinal midpoint of the drum, and which serve to lift the milled material onto the inlet end 18 of the conveyor system 16 during operative rotation of the drum.

To replace a cutting tooth 62 of the apparatus of the present invention, it is only necessary to engage and drive the tooth from the bore by inserting a punch into the rear of the bore and tapping the punch axially against the end of the shaft 61 of the tooth. The offset lateral spacing of the assemblies, and the inclination of the bore 60, permit the punch to be easily inserted and tapped.

The procedure for removing and replacing a tooth holder 45 is illustrated in FIGS. 5 and 6. In this regard, it will be understood that while the lower portion of the holder is protected by the overlying base plate 26 of the adjacent assembly, the upper portion of the holder is typically covered with dried asphalt, and it may be tightly locked in its operative position. To effect removal, the bolt 55 is removed, and the upper portion of the holder is tapped with a hammer as indicated by the arrow in FIG. 7, causing the holder to break loose and pivot forwardly. The beveled lower surface 64 at the bottom end of the holder, together with the reduced radial height of the forward support block 38 permits this pivotal action. The holder may then be easily lifted from the channel and replaced.

To describe the operation of the apparatus, it will be understood that the vehicle is moved relatively slowly along the roadway surface by the tracks 12, and that a truck is positioned in front of the vehicle and below the outlet end 20 of the conveyor for receiving the milled material. The drum cutter 14 is rotated in the indicated direction so that the cutting teeth 62 of the assemblies and the laterally extending lifting plates 68 move through the roadway surface in the forward direction. Also, the arrangement of the assemblies 24 in the two oppositely directed helices tends to laterally convey the milled material toward the longitudinal midpoint of the drum, and the laterally extending blades 68 then serve to lift the milled material into the inlet end 18 of the conveyor system 16.

Viewing FIG. 2, it will be seen that the heads 66 of the bolts are positioned on the sides of the assemblies 24 opposite the sides which move the milled material laterally toward the center of the drum. Thus the bolt heads 66 are subjected to minimal load and wear. Also, it will be seen that the cutting teeth 62 on the right side of the drum as seen in FIG. 2 are oriented laterally toward the center of the drum by reason of the lateral inclination of the surfaces 56 and bores 60, and the teeth on the left side are similarly oriented toward the center. This orientation is believed to provide better balance of the cutting load.

The drum 14 is typically rotated at a speed such that the teeth 62 have a tip speed of about 1000 feet per minute, which is achieved at a rotational speed of about 90 rpm.

In the drawings and specification, there has been set forth a preferred embodiment of the invention, and although specific terms are employed, they are used in a generic and descriptive sense only and not for purposes of limitation.

That which is claimed is:

1. A cutter drum adapted for milling a roadway surface so as to remove a layer of asphalt or the like, and comprising a cylindrical drum surface defining a central axis, a plurality of flighting assemblies fixed to said surface of the cutting drum in a helical configuration, with each flighting assembly comprising (a) a base plate having an inner edge fixed to said surface of said drum, an outer edge generally concentric to said surface of said drum, an inner side surface and an opposite outer side surface, and with said base plate being aligned with a plane which perpendicular intersects said central axis, (b) a rear support block fixed to said outer side surface of said base plate, said rear support block having an outer surface on the side thereof opposite said base plate, (c) a forward support block fixed to said outer side surface of said base plate and spaced from said rear support block so as to define a channel therebetween which is directed generally radially with respect to said central axis, and with said forward support block having an outer surface on the side thereof opposite said base plate, (d) a tooth holder positioned in said channel and having an outer portion which extends radially above said outer edge of said base plate, (e) means releasably mounting said tooth holder in said channel, and (f) a cutting tooth mounted to said outer portion of said tooth holder, said flighting assemblies being arranged in a laterally side by side and circumferentially offset relationship so as to define said helical configuration, and with said outer surface of at least one of said rear and forward support blocks and the adjacent surface portion of said tooth holder of each flighting assembly being covered by the inner side surface of the base plate of an adjacent flighting assembly.

2. The apparatus as defined in claim 1 wherein said tooth holder of each assembly has a lower end edge which engages said surface of said drum so as to provide support to said holder in the radial direction.

3. The apparatus as defined in claim 1 wherein said channel of each assembly is defined by a forwardly facing surface on said rear support block and a rearwardly facing surface on said forward support block, and wherein said tooth holder includes a rear edge opposing and contacting said forwardly facing surface and a forward edge opposing and contacting said rearwardly facing surface.

4. The apparatus as defined in claim 3 wherein said means releasably mounting said tooth holder comprises a bolt extending laterally through said holder and said base plate.

5. The apparatus as defined in claim 4 wherein said forward support block of each assembly has a radial height substantially less than that of said rear support block, and wherein said rear edge of said tooth holder has a removed portion communicating with said lower end edge thereof and so as to permit the tooth holder to pivot forwardly about a lateral axis and thereby facilitate the removal thereof.

6. A cutter drum adapted for milling a roadway surface so as to remove a layer of asphalt or the like, and comprising a cylindrical drum surface defining a central axis, a plurality of flighting assemblies fixed to said surface of the cutting drum in a helical configuration, with each flighting assembly comprising (a) a base plate having an inner edge fixed to said surface of said drum, an outer edge generally concentric to said surface of said drum, an inner side surface and an opposite outer side surface, and a forward end portion and a rear end portion, (b) a rear support block fixed to said outer side surface of said base plate at the rear end portion thereof, said rear support block having planar outer surface on the side thereof opposite said base plate, (c) a forward support block fixed to said outer side surface of said base plate forwardly of said rear support block so as to define a channel therebetween which is directed generally radially with respect to said central axis, and with said forward support block having a planar outer surface on the side thereof opposite said base plate and which is coplanar with said outer surface of said rear support block, (d) a tooth holder positioned in said channel and having an outer portion which extends radially above said outer edge of said base plate, (e) means releasably mounting said tooth holder in said channel, and (f) a cutting tooth mounted to said outer portion of said tooth holder, said flighting assemblies being arranged such that said coplanar outer side surfaces of said rear and forward support blocks of each assembly are covered and engaged by the inner side surface of the base plate of an adjacent assembly at the forward end portion thereof, and such that the inner side surface of the adjacent assembly overlies the channel and the lower portion of the tooth holder of the first mentioned assembly.

7. The apparatus as defined in claim 6 wherein said tooth holder of each assembly has a lower end edge which engages the surface of said drum so as to provide support to said holder in the radial direction.

8. The apparatus as defined in claim 7 wherein said channel of each assembly is defined by a forwardly facing surface on said rear support block and a rearwardly facing surface on said forward support block, and wherein said tooth holder includes a rear edge opposing and contacting said forwardly facing surface and a forward edge opposing and contacting said rearwardly facing surface.

9. The apparatus as defined in claim 8 wherein said means releasably mounting said tooth holder comprises a bolt extending laterally through said holder and said base plate.

10. The apparatus as defined in claim 9 wherein said forward support block of each assembly has a radial height substantially less than that of said rear support block, and wherein said rear edge of said tooth holder has a removed portion communicating with said lower end edge thereof and so as to permit the tooth holder to pivot forwardly about a lateral axis and thereby facilitate the removal thereof.

11. The apparatus as defined in claim 6 wherein said base plate of each assembly is aligned with a plane which perpendicularly intersects said central axis, and wherein the base plates of the assemblies are laterally offset from each other by the lateral width of said rear and forward support blocks to define said helical configuration.

12. The apparatus as defined in claim 11 wherein said means releasably mounting said tooth holder comprises a bolt extending laterally through said holder and said base plate, and whereein said bolt of each assembly includes a head positioned adjacent said inner side surface of said base plate, and wherein said apparatus further comprises a prime mover which rotates said drum in an operative direction wherein the milled asphalt material is laterally conveyed by engagement with the side of said assemblies opposite said bolt heads so that said bolt heads receive little wear.

13. An apparatus for milling a roadway surface so as to remove a layer of asphalt or the like, and comprising a wheeled vehicle, a cutter drum mounted to said vehicle for rotation about a generally horizontal central axis and so as to engage the roadway surface, prime mover means mounted to said vehicle for advancing the apparatus along the roadway and for rotating said drum about said central axis, a plurality of flighting assemblies fixed to the surface of the cutting drum in a helical configuration, with each flighting assembly comprising (a) a base plate having an inner edge fixed to the surface of said drum, an outer edge generally concentric to the surface of said drum, an inner side surface and an opposite outer side surface, a forward end portion and a rear end portion, and with said base plate being aligned with a plane which perpendicularly intersects said central axis, (b) a rear support block fixed to said outer side surface of said base plate at the rear end portion thereof, said rear support block having planar outer surface on the side thereof opposite said base plate, (c) a forward support block fixed to said outer side surface of said base plate forwardly of said rear support block so as to define a channel therebetween which is directed generally radially with respect to said central axis, and with said forward support block having a planar outer surface on the side thereof opposite said base plate and which is coplanar with said outer surface of said rear support block, (d) a tooth holder positioned in said channel and having an outer portion which extends radially above said outer edge of said base plate, (e) means releasably mounting said tooth holder in said channel, and (f) a cutting tooth mounted to said outer portion of said tooth holder, said flighting assemblies being arranged such that said coplanar outer side surfaces of said rear and forward support blocks of each assembly are covered and engaged by the inner side surface of the base plate of an adjacent assembly at the forward end portion thereof, and such that the inner side surface of the adjacent assembly overlies the channel and the lower portion of the tooth holder of the first mentioned assembly.

14. The apparatus as defined in claim 13 wherein said apparatus further comprises conveyor means having an inlet end positioned immediately forwardly of said drum and an elevated outlet end positioned forwardly of said apparatus, and wherein said prime mover means acts to rotate said drum in an operative direction so that said cutting teeth of said assemblies move through the asphalt roadway surface in the forward direction and thereby tend to lift the milled material into the inlet end of said conveyor means.

15. The apparatus as defined in claim 14 wherein said flighting assemblies are arranged to define oppositely directed helices which are positioned on respective opposite halves of said cutting drum, and so that rotation of said drum in said operative direction acts to convey the milled material toward the longitudinal midpoint of said drum.

16. The apparatus as defined in claim 15 wherein said cutting drum further mounts a plurality of laterally extending and radially directed lifting plates which extend between laterally adjacent flighting assemblies, and which serve to lift the milled material onto said inlet end of said conveyor means during operative rotation of said drum.

* * * * *